US009521724B1

(12) United States Patent
Berry et al.

(10) Patent No.: US 9,521,724 B1
(45) Date of Patent: Dec. 13, 2016

(54) METHOD FOR AUTOMATICALLY COMMISSIONING DEVICES USED IN BUILDING LIGHTING AND CONTROLS

(75) Inventors: Travis Berry, Madison, AL (US); Eric Spika, Vancouver (CA)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 1016 days.

(21) Appl. No.: 13/537,241

(22) Filed: Jun. 29, 2012

Related U.S. Application Data

(60) Provisional application No. 61/532,581, filed on Sep. 9, 2011.

(51) Int. Cl.
*H05B 37/02* (2006.01)
*H05B 39/04* (2006.01)
*H05B 41/36* (2006.01)

(52) U.S. Cl.
CPC ..... *H05B 37/02* (2013.01); *H05B 37/0272* (2013.01)

(58) Field of Classification Search
CPC .... H05B 37/0272; H05B 37/034; H05B 37/02
USPC ..... 315/149–159
See application file for complete search history.

(56) References Cited

U.S. PATENT DOCUMENTS 5,838,116 A 11/1998 Katyl et al.
6,583,573 B2 6/2003 Bierman
7,531,922 B1 5/2009 Olson
7,710,271 B2 * 5/2010 Frumau ..... H05B 37/0272 250/227.21
8,049,434 B2 * 11/2011 Crouse et al. ..... 315/291
8,093,817 B2 * 1/2012 Frumau ..... H05B 37/0272 250/227.21
2002/0043938 A1 * 4/2002 Lys ..... H04L 29/12254 315/149
2004/0217718 A1 11/2004 Kumar et al.
2005/0231134 A1 * 10/2005 Sid ..... H05B 37/0272 315/294
2008/0074059 A1 3/2008 Ahmed
2008/0218087 A1 * 9/2008 Crouse ..... H05B 37/0245 315/131
2011/0199004 A1 * 8/2011 Henig et al. ..... 315/152

* cited by examiner

*Primary Examiner* — Lincoln Donovan
*Assistant Examiner* — Metasebia Retebo
(74) *Attorney, Agent, or Firm* — Patterson Intellectual Property Law, P.C.; Mark J. Patterson; Gary L. Montle

(57) ABSTRACT

A lighting system includes a system controller, at least one light fixture, and at least one non-fixture system device. The system controller initiates automated commissioning by instructing a light fixture of the lighting system to modulate light output by the light fixture with a commissioning code. At least one system device of the lighting system receives the modulated light output and demodulates the received light output to determine the commissioning code. In response to determining the commissioning code, the at least one system device sends an acknowledgment message to the system controller. The system controller associates the system devices sending an acknowledgment message with the light fixture providing the light output modulated with the commissioning code.

34 Claims, 3 Drawing Sheets

METHOD FOR AUTOMATICALLY COMMISSIONING DEVICES USED IN BUILDING LIGHTING AND CONTROLS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: U.S. Provisional Patent Application No. 61/532,581, filed Sep. 9, 2011.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

This invention relates generally to lighting control systems. More particularly, the present invention pertains to methods and systems for commissioning light fixtures and other system devices with a system controller in a lighting system.

Lighting control systems are used to control and manage system devices that are part of a building lighting system. These managed devices may include occupancy sensors, light sensors, switches and lighting fixtures. Lighting systems and control systems are generally commissioned after the devices are installed. The commissioning process may include assigning devices to a particular area, defining the interaction of a device with other devices, and defining the behavior of a particular system device.

Commissioning light fixtures and system devices in a lighting control system is conventionally accomplished manually. For example, a lighting system installer may walk throughout a facility and assign and/or record unique addresses for each system device and light fixture. The addresses are stored locally in the system devices and light fixtures and entered, either real-time or thereafter, into a lighting system controller. The unique addresses may be entered in the system devices and light fixtures via DIP switch manipulation or in a memory location of the system device or light fixture via infrared, short distance radio communication, or wired communication link.

Manually commissioning the system devices and the light fixtures of the lighting system is time-consuming, expensive, and error-prone. Errors are difficult to identify and are time-consuming to correct.

BRIEF SUMMARY OF THE INVENTION

In one aspect of the present invention, a system controller instructs, in turn, each light fixture of a lighting system via a communication link to modulate light output by a lamp of the light fixture to transmit a commissioning code. Light output by the lamp may be modulated by increasing and decreasing an intensity of light output by the lamp, by shifting a phase of the light output by the lamp, or by increasing or decreasing a frequency of the light output by the lamp. Modulating light output by a lamp is disclosed in, for example, U.S. Pat. No. 6,333,604, the disclosure of which is incorporated herein by reference in its entirety. At least one system device of the lighting system receives the transmitted commissioning code and sends an acknowledgement message to the system controller via the communication link. The system controller can thus associate light fixtures with system devices of the lighting system in groups, areas, or zones.

In one aspect, one or more system devices installed in a lighting system and coupled to a communication link are commissioned. The lighting system includes at least one light fixture coupled to the communication link. The light fixture receives a commissioning command from the communication link. The light fixture modulates a light output in response to the received commissioning command. The modulated light output defines a commissioning code. One or more system devices receives the modulated light output. The one or more system devices receiving the modulated light output demodulates the modulated light output to determine the commissioning code. In response to determining the commissioning code, the one or more system devices sends an acknowledgement message via the communication link.

In one aspect, a light fixture for use in a lighting system having a system controller coupled to a communication link includes a light fixture and a light fixture controller. The light fixture controller is operable to receive a commissioning command from the system controller via the communication link. The light fixture controller is further operable to provide a control signal with a commissioning code.

In one aspect, a system device for a lighting system is configured for automated commissioning. The system device includes a light sensor and a system device controller. The light sensor is operable to receive light output by a light fixture of the lighting system and provide a signal indicative of the received light. The system device controller is operable to receive the signal indicative of the received light, demodulate the received signal indicative of the received light to determine a commissioning code with which the received light is modulated, and send an acknowledgement message to a system controller of the lighting system via a communication link of the lighting system in response to determining the commissioning code.

In one aspect, a system controller for a lighting system configured for automated commissioning includes a processor and a memory. The processor is operable to send a commissioning command to a light fixture of the lighting system via a communication link. The commissioning command instructs the light fixture to output light modulated with a commissioning code. The processor is operable to receive from each of one or more system devices, an acknowledgement message via the communication link in response to the system device determining said commissioning code modulated in light output by the light fixture. The processor is operable to provide data as a function of the received acknowledgement message. The memory is operable to receive the data provided by the processor and store an address of the light fixture together with an address of each of the one or more system devices sending an acknowledgement message.

In one aspect, a lighting system includes a communication link, at least one light fixture connected to the communication link, and one or more system devices connected to the communication link. The at least one light fixture connected to the communication link may be a lamp, a light fixture controller, or a ballast. The light fixture is operable to output light from the lamp modulated with a commissioning code in response to receiving a commissioning command via the communication link. Each of the system devices is connected to the communication link and may include a light sensor and a system device controller. The light sensor is operable to generate a light sensor output signal that is indicative of modulated light output from the light fixture received at the system device. The system device controller is operable to demodulate the light sensor output signal to determine the commissioning code modulated on the light received at the system device. The system device controller may include a signal transmitter operable to transmit an acknowledgement message via the communication link in response to determining a commissioning code.

In one aspect, system devices in a lighting system are automatically commissioned. A light fixture of the lighting system modulates light output to send an initialize command to a targeted system device in the lighting system. The targeted system device receives the initialize command by sensing the modulated light output from the light fixture. The targeted system device sends an acknowledgment message in response to receiving the initialize command.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified.

DETAILED DESCRIPTION OF THE INVENTION

Figure 1:
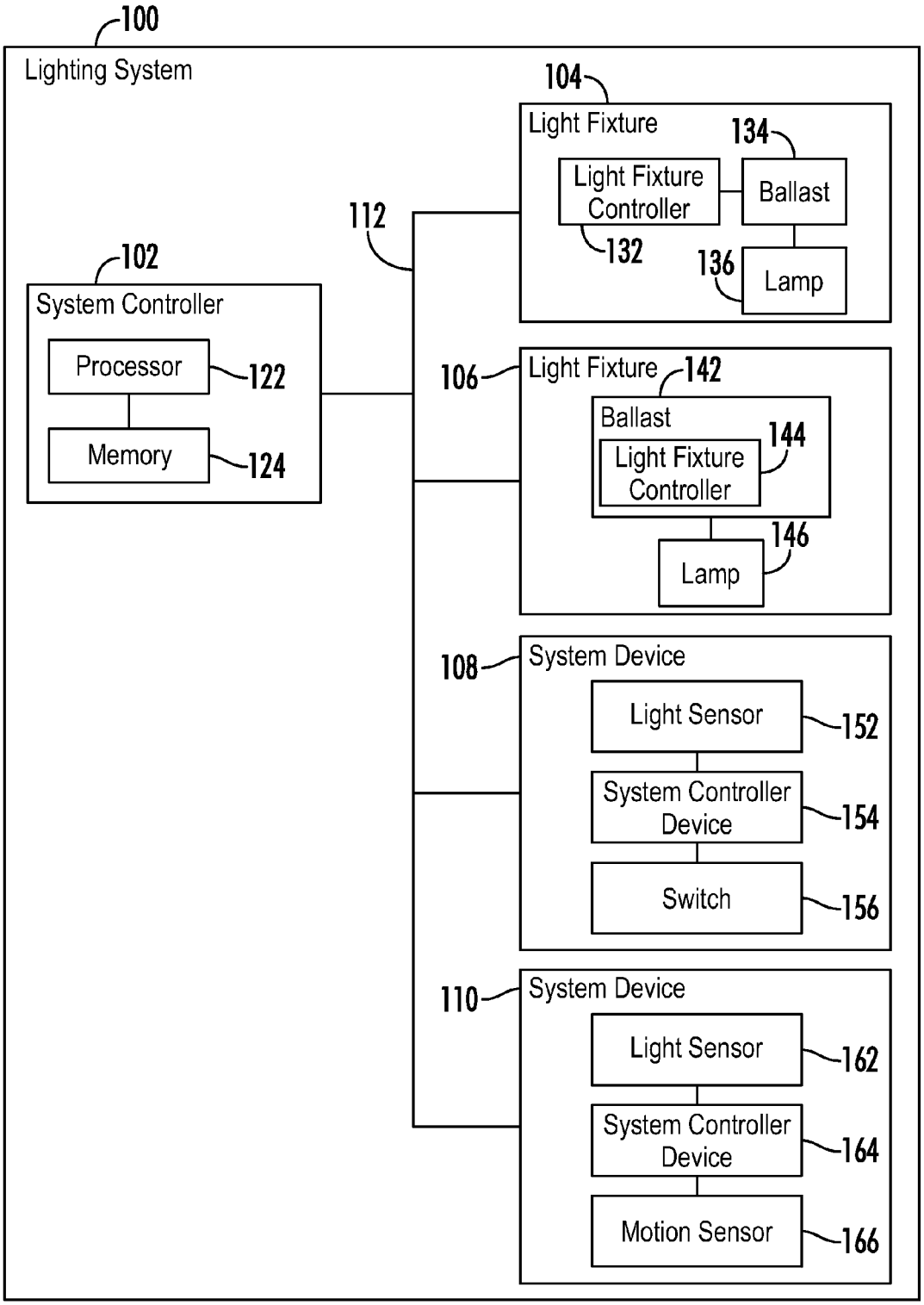
FIG. 1 is a block diagram of an embodiment of a lighting system capable of automated commissioning in accordance with the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

One embodiment of the present invention enables automated or automatic commissioning of system devices and light fixtures installed in a lighting system including a system controller and a communication link. System devices include, but are not limited, to occupancy sensors, light sensors, and light switches. Commissioning includes assigning system devices and light fixtures to a particular group, area, or zone, defining their interaction with other system devices or light fixtures, or defining their behavior. The system controller may be included in a controller of one or more system device or light fixtures.

When automated commissioning is initiated, the system controller selects a first unassigned light fixture in the lighting system and instructs it via the communication link, to begin transmitting a code. The non-fixture system devices (e.g., occupancy sensors, light sensors, and wall switches) are equipped with light sensors. The system controller commands these devices via the communication link to monitor for the code being transmitted by the first unassigned light fixture. System devices, which are aware of their function, and receive the transmitted code, respond to the system controller via the communication link. The response includes their function (e.g., switch, occupancy sensor, or light sensor, etc.) and their preset address. The system controller then proceeds to a second unassigned light fixture in the lighting system and instructs it via the communication link, to begin transmitting a code. The non-fixture system devices (e.g., occupancy sensors, light sensors, and wall switches) are equipped with light sensors. The system controller commands these devices via the communication link to monitor for the code being transmitted by the second unassigned light fixture. System devices, which are aware of their function, and receive the transmitted code, respond to the system controller via the communication link. The response includes their function (e.g., switch, occupancy sensor, or light sensor, etc.) and their preset address.

Referring to FIG. 1, a lighting system 100 in accordance with the present invention may include a system controller 102, a first light fixture 104, and a second light fixture 106, a first system device 108, a second system device 110, and a communication link 112. In one embodiment, the communication link 112 includes a gateway (not shown) for enabling communication between the system controller 102 and the light fixtures 104, 106 and system devices 108, 110 of the lighting system 100. The system controller 102 may be off-site (i.e., located at a facility other than the facility in which the light fixtures 104, 106 and system devices 108, 110 are installed). The communication link 112 may be any combination of wired and wireless connections and protocols, including a power line communication network, or Ethernet network. The optional gateway (not shown) may provide a link between an on-site communication network and an off-site communication network and/or adapt one communication protocol to another communication protocol on-site or off-site.

The system controller 102 may include a processor 122 and a memory 124. The processor 122 is operable to send a commissioning command to each light fixture 104, 106 in the lighting system 100 in turn. For example, when the processor 122 sends the commissioning command to the first light fixture 104, the first light fixture 104 outputs light modulated to define a commissioning code. In one embodiment, the commissioning code is an address of the first light fixture 104. In another embodiment, the commissioning code is an identifier associated with a group, area, or zone of the first light fixture 104. The modulation may be any combination of frequency modulation, phase modulation, or amplitude modulation. The light output by the first light fixture 104 is received by one or more system devices of the lighting system 100.

If, for example, the first system device 108 receives the light output by the first light fixture 104, then the first system device 108 demodulates the received light output by the first light fixture 104. If the first system device 108 determines the commissioning code, then the first system device 108 sends an acknowledgment message to the system controller 102 via the communication link 112. The processor 122 of the system controller 102 provides data to the memory 124 as a function of the received acknowledgment message. The memory 124 stores an address of the first light fixture 104 together with an address of the first system device 108 such that the first light fixture 104 and the first system device 108 are known by the system controller 102 to be located in the same area, group, or zone of a facility in which the lighting system 100 is installed. If the second system device 110 receives the light output by the first light fixture 104 and determines the commissioning code, then the second system device 110 also provides an acknowledgment message to the system controller 102 via a communication link 112.

Examples of system controller 102 include a dedicated lighting controller, a general-purpose computer, or a building management system. The system controller 102 may be on-site in the facility in which the lighting system 100 is installed or remote from the facility. In one embodiment, the acknowledgment message received at the processor 102 may be a function of the system device sending the acknowledgment message and a predetermined address of the system device sending the acknowledgment message. In another embodiment, the acknowledgment message does not include the address of the system device sending the acknowledgment message, and the system controller 102 responds to the acknowledgment message by providing a unique address to the system device sending the acknowledgment message.

The first light fixture 104 may include a light fixture controller 132, a ballast 134, and a lamp 136. As used herein, ballast includes driver circuits and/or controllers of any form capable of modulating light output by a lamp, and lamp includes all light sources such as fluorescent lamps, incandescent bulbs, high intensity discharge lamps, LED's, OLED's, and plasmoidals. In the first light fixture 104, the light fixture controller 132 and the ballast 134 are separate, distinct components. The light fixture controller 132 receives the commissioning command from the system controller 102 via the communication link 112 and provides a control signal with the commissioning code to the ballast 134. In one embodiment, the control signal provided by the light fixture controller 132, is modulated with the commissioning code. In one embodiment, the commissioning code identifies an address, area, group, or zone associated with the first light fixture 104. In one embodiment, the first light fixture 104 is a fluorescent light fixture, wherein the lamp 136 is a fluorescent lamp. In another embodiment, the first light fixture 104 is a light emitting diode fixture, and the lamp 136 is a light emitting diode.

The second light fixture 106 comprises a ballast 142 having a light fixture controller 144 and a lamp 146. In the second light fixture 106, the light fixture controller 144 is integral with the ballast 142. The second light fixture 106 operates similarly to the first light fixture 104 with respect to receiving commissioning commands and providing light output modulated with a commissioning code for automated or automatic commissioning.

The first system device 108 may be a light switch having a light sensor 152, a system device controller 154, and a switch 156. The light sensor 152 receives light output by at least one light fixture of the lighting system 100 and provides a signal indicative of the received light. The system device controller 154 receives the signal indicative of the received light and demodulates the signal to determine a commissioning code with which the light received by the light sensor 152 is modulated.

In response to determining the commissioning code, the system device controller 154 sends an acknowledgment message to the system controller 102 via the communication link 112. The switch 156 receives input from a user, and the system device controller 154 relays the received input to the system controller 102 via the communication link 112. In one embodiment, the input from the user turns light fixtures associated with a group, area, or zone of the first system device 108 on or off. In one embodiment, the acknowledgment message may be a function of the first system device 108 and a predetermined address of the first system device 108. The acknowledgment message may also include the commissioning code. In one embodiment, the commissioning code identifies a group, area, or zone of the first system device 108. In one embodiment, the system controller 102 responds to the acknowledgment message from the first system device 108 by sending a unique address to the first system device 108. The unique address is recorded in the memory 124 of the system controller 102 and a memory of the system device controller 154 of the first system device 108.

In one embodiment, during automated commissioning, the first system device 108 determines a plurality of unique commissioning codes modulated in light output from a plurality of unique light fixtures and sends an acknowledgment message to the system controller 102 for each unique commissioning code determined by the system device controller 154 of the first system device 108. This enables the system controller 102 to optimize the association of light fixtures and system devices with each group, area, or zone.

The second system device 110 may be an occupancy sensor that includes a light sensor 162, a system device controller 164, and a motion sensor 166. The occupancy sensor 110 operates similarly to the light switch 108 with respect to receiving modulated light, determining a commissioning code, and sending an acknowledgement message for automated or automatic commissioning. The motion sensor 166 detects movement in an area or zone proximate the motion sensor 166 and provides an input to the system device controller 164 of the occupancy sensor 110. The system device controller 164 provides the input to the system controller 102 via the communication link 112. The system controller 102 turns on one or more light fixtures associated with a group, area, or zone of the second system device 110 in response to the received input. In one embodiment, the system device controller 102 provides input to the system controller 102 to turn off the light fixtures in a group, area, or zone associated with the second system device 110 after a predetermined period of time without input from the motion sensor 166.

The system devices of the lighting system 100 may also include light sensors. In one embodiment, light sensors are used to determine which light fixtures of the lighting system 100 are included in a group, area, or zone associated with the light sensor. In one embodiment, light sensors operate similarly with respect to receiving modulated light, determining a commissioning code, and sending an acknowledgement message for automated or automatic commissioning. In one embodiment, light sensors provide input to the system controller 102 such that the system controller 102 may operate light fixtures of the lighting system 100 to maintain light levels in a zone, group, or area associated with a light sensor at a predetermined level.

Figure 2:
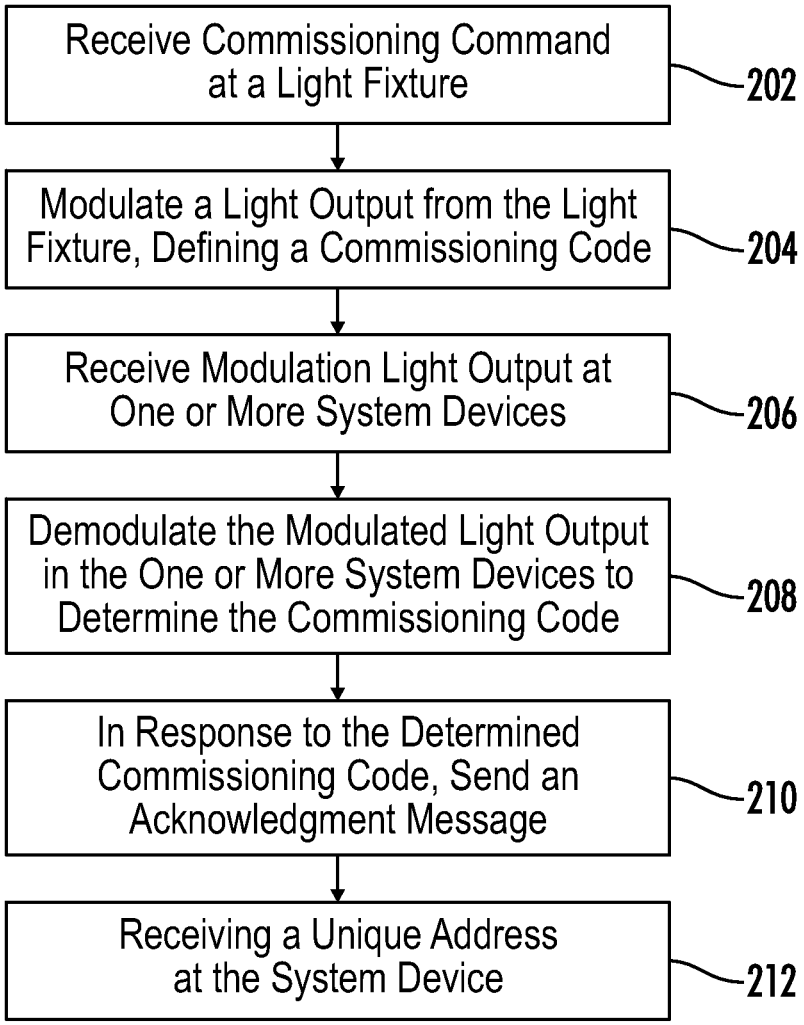
FIG. 2 is a flowchart of an embodiment of a method of commissioning system devices installed in a lighting system in accordance with the present invention.

Referring to FIG. 2, a method of commissioning one or more system devices installed in a lighting system and coupled to a communication link begins at step 202 with receiving a commissioning command via the communication link at a light fixture of the lighting system. At step 204, in response to receiving the commissioning command, the light fixture modulates light output by the light fixture to define a commissioning code. The modulated light output is received at one or more system devices of the lighting system at step 206. At step 208, the one or more system devices receiving the modulated light output demodulate the modulated light output to determine the commissioning code. In response to determining the commissioning code, the one or more system devices each send an acknowledgment message via the communication link at step 210. Optionally, at step 212, a unique address is received at the one or more system devices sending an acknowledgment message. The unique address may define a group, area, or zone with which the system device is to be associated. In one embodiment, the commissioning command is received from a system controller of the lighting system and the acknowledgement message is sent to the system controller. In one embodiment, the commissioning code is an address of the light fixture providing the modulated light output. In one embodiment, the system controller sends the commissioning command in turn to each light fixture of a plurality of light fixtures of the lighting system. In one embodiment, the acknowledgment message sent from each of the one or more system devices in response to determining the commissioning code may be a function of the system device and a predetermined address of the system device.

Figure 3:
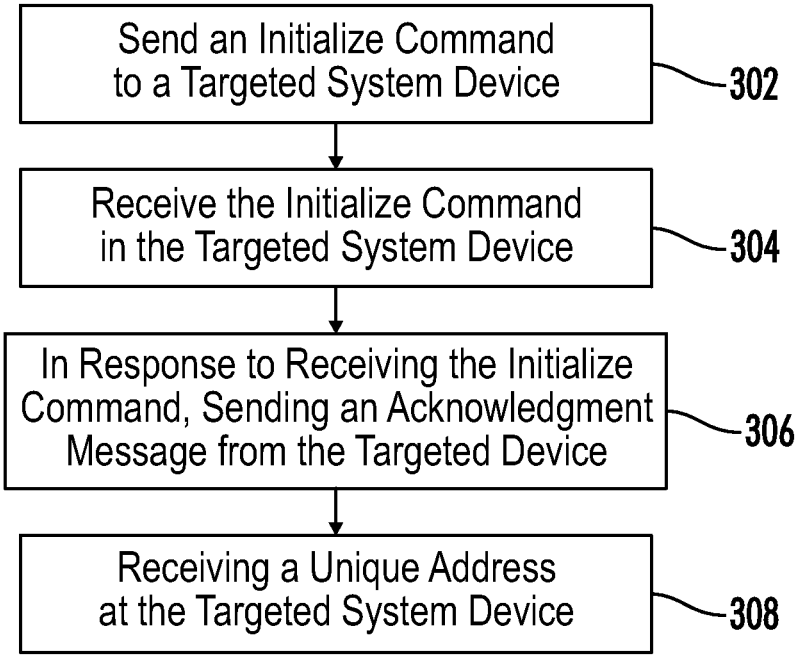
FIG. 3 is a flowchart of a method of initializing system devices in a lighting system.

Referring to FIG. 3, a method of initializing system devices in a lighting system begins at step 302 by sending an initialize command to a targeted system device in the lighting control system by modulating a light output from a light fixture of the lighting system. At step 304, the initialize command is received in the targeted system device by sensing the modulated light output from the light fixture. In response to receiving the initialize command at step 304, the targeted system device sends an acknowledgment message at step 306. Optionally, at step 308, the targeted system device receives a unique address. In one embodiment, the unique address received at the targeted system device identifies a group, area, or zone associated with the system device. In another embodiment, the unique address is an address assigned to the targeted system device by a system controller of the lighting system. In one embodiment, the initialize command is received at the light fixture from the system controller of the lighting system. In one embodiment, the initialize command comprises an address of the light fixture. In one embodiment, the acknowledgment message may be a function of the targeted system device and a predetermined address of the targeted system device.

In one embodiment of the present invention, the manual walk-through conventionally associated with commissioning is reduced or eliminated by automatically determining the system device locations and automatically setting the associations of the system devices with groups, areas, or zones. Embodiments include, but are not limited to, occupancy sensors, light switches, light fixtures, light sensors, system controllers, and methods of automatically commissioning these devices in a lighting system. The system controller may be embedded in one or more system devices, a local or remote application specific computer or processor or a local or remote general purpose computer connected to the system devices and light fixtures by any combination or type of communication link.

In one embodiment, a lamp is modulated (via flashing) to transmit a commissioning code to identify the group, area, or zone covered by the lamp. The commissioning code may be simple and reused with multiple light fixtures. The automated or automatic commissioning method is initiated from the system controller. It is also contemplated that light output by the lamp may be modulated via frequency modulation and/or phase modulation to transmit a commissioning code.

In one embodiment, when the automated or automatic commissioning method is initiated, the system controller selects the first unassigned light fixture in the lighting system and commands or instructs it to begin transmitting the commissioning code. The non-fixture system devices (e.g., occupancy sensors, light sensors, and wall switches) are equipped with light sensors. The system controller commands these devices to "look" for or monitor for the commissioning code being transmitted by the light fixture. System devices, which are aware of their function and receive the transmitted signal including the commissioning code, respond to the system controller via the control bus (i.e., the communication link) with an acknowledgment message including their function (e.g., light sensor, light switch, or occupancy sensor) and their preset address. When the system devices receiving the signal transmitted by the first unassigned light fixture are assigned an address by the system controller and the address is recorded, the system controller moves on to a second unassigned fixture of the lighting system, and the method is repeated. The method continues until all light fixtures of the lighting system have been selected by the system controller and all system devices. The system controller may also assign light fixtures and system devices of the lighting system to groups, areas, or zones.

In another embodiment, when the system controller initiates automatic commissioning, the system controller selects the first unassigned light fixture in the lighting system and commands it to begin transmitting the commissioning code. The non-fixture system devices (e.g., occupancy sensors, light sensors, and wall switches) are equipped with light sensors. The light fixture will transmit an "initiate" signal. The devices sense the initiate signal and send their function and address to the controller via the control bus (i.e., communication link). The information includes their function (e.g., switch, light sensor, or occupancy sensor) and their preset or predetermined address. When the system devices receiving the signal transmitted by the first unassigned light fixture are assigned an address by the system controller and the address is recorded, the system controller moves on to a second unassigned fixture of the lighting system, and the method is repeated. The method continues until all light fixtures of the lighting system have been selected by the system controller and all system devices. The system controller may also assign light fixtures and system devices of the lighting system to groups, areas, or zones.

In yet another embodiment, when the system controller initiates automatic commissioning, the system controller selects the first unassigned light fixture in the lighting system and commands it to begin transmitting the commissioning code. The non-fixture system devices (e.g., occupancy sensors, light sensors, and wall switches) are equipped with light sensors. The light fixture transmits an "initiate" signal. The system devices sense the initiate signal and send their function to the system controller via the control bus (i.e., communication link). The system device then negotiates with the system controller and a unique address is assigned to and communicated to the system device. The address is recorded in a memory of the system device as well as in a memory of the system controller. When the system devices receiving the signal transmitted by the first unassigned light fixture are assigned an address by the system controller and the address is recorded, the system controller moves on to a second unassigned fixture of the lighting system, and the method is repeated. The method continues until all light fixtures of the lighting system have been selected by the system controller and all system devices. The system controller may also assign light fixtures and system devices of the lighting system to groups, areas, or zones.

Depending on the speed of the communication link, automatically commissioning a large facility can be completed in a much shorter time and with fewer errors than manual commissioning.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art.

Although embodiments of the present invention have been described in detail, it will be understood by those skilled in the art that various modifications can be made therein without departing from the spirit and scope of the invention as set forth in the appended claims.

A controller, computing device, or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful Method for Automatically Commissioning Devices Used in Building Lighting and Controls it is not intended that such references be construed as limitations upon the scope of this invention except as set forth in the following claims.

What is claimed is:

1. A method of commissioning one or more system devices installed in a lighting system and coupled to a communication link, the lighting system including a system controller and at least one light fixture coupled to the communication link, said method comprising:

receiving in the light fixture a commissioning command from the system controller via the communication link;

modulating a light output from the light fixture in response to the received commissioning command, the modulated light output defining a unique commissioning code corresponding to the light fixture;

receiving the modulated light output at the one or more system devices;

demodulating the modulated light output in the one or more system devices to determine the commissioning code from a plurality of unique commissioning codes; and in response to the determined commissioning code, sending to the system controller via the communication link an acknowledgement message from the one or more system devices.

2. The method of claim 1, wherein the step of modulating the light output from the light fixture comprises varying the light output from a lamp powered by a ballast;

the commissioning code comprises an address associated with the light fixture; and each of the one or more system devices in the lighting system comprises a light sensor, a light switch, or an occupancy sensor.

3. The method of claim 2, wherein the system comprises a plurality of light fixtures and the system controller sends a commissioning command to each of the plurality of light fixtures.

4. The method of claim 1, wherein the acknowledgement message sent from each of the one or more system devices in response to determining the commissioning code comprises a function of the system device and a predetermined address of the system device.

5. The method of claim 1, wherein the acknowledgement message sent from each of the one or more system devices to the system controller in response to determining the commissioning code comprises a function of the system device.

6. The method of claim 5, wherein the system controller includes system memory, each of the system devices include a device memory, the method further comprising the steps of:

in response to sending the acknowledgement message, receiving a unique address at each of the one or more system devices sending an acknowledgement message, wherein the unique address is recorded in the system memory and in the device memory of the system device receiving the unique address.

7. A light fixture for use in a lighting system having a system controller coupled to a communication link, said light fixture comprising:

a light fixture controller operable to receive a commissioning command from the system controller via the communication link; and wherein the light fixture controller is further operable to provide a control signal modulated in accordance with a unique commissioning code from a plurality of unique commissioning codes in the lighting system.

8. The light fixture of claim 7, wherein:

the light fixture controller is operable to store the commissioning code; and the commissioning code is provided by the system controller in the commissioning command or the commissioning code is predetermined and stored in light fixture controller.

9. The light fixture of claim 7, further comprising:

a ballast operable to provide power to a lamp as a function of the control signal such that the provided power is modulated with the commissioning code; and a lamp operable to output light in response to receiving power from the ballast, such that the light output by the lamp is modulated with the commissioning code.

10. The light fixture of claim 9 wherein the ballast comprises the light fixture controller.

11. The light fixture of claim 9, wherein the light fixture is a fluorescent light fixture, and the lamp is a fluorescent lamp.

12. The light fixture of claim 9, wherein the light fixture is a light emitting diode fixture, and the lamp is a light emitting diode.

13. The light fixture of claim 8, wherein the commissioning code is an address of the light fixture and said address is stored in the system controller and the light fixture controller during commissioning.

14. A system device for a lighting system configured for automated commissioning, said system device comprising:

a light sensor operable to receive light output by a light fixture of the lighting system and provide a signal indicative of the received light;

a system device controller operable to:

receive the signal indicative of the received light;

demodulate the received signal indicative of the received light to determine a commissioning code with which the received light is modulated, wherein the determined commissioning code is one of a plurality of unique commissioning codes and corresponding to the light fixture providing the light output; and send an acknowledgement message to a system controller of the lighting system via a communication link of the lighting system in response to determining the commissioning code.

15. The system device of claim 14, wherein the system device is a light switch, and the system device further comprises a switch operable to receive input from a user and relay the received input to the system controller via the communication link.

16. The system device of claim 14, wherein the system device is an occupancy sensor, and the system device further comprises a motion sensor operable to detect movement in a zone and provide an input to the system controller via the communication link in response to detecting movement in the zone.

17. The system device of claim 14, wherein the acknowledgement message comprises a function of the system device and a predetermined address of the system device.

18. The system device of claim 14, wherein the acknowledgement message comprises a function of the system device.

19. The system device of claim 18, wherein the system controller responds to the acknowledgement message from the system device by sending a unique address to the system device, wherein the unique address is stored in a memory of the system controller and a memory of the system device controller during commissioning.

20. The system device of claim 14, wherein during automated commissioning, the system device determines a plurality of unique commissioning codes modulated in light output by a plurality of unique light fixtures, and the system device sends the acknowledgement message to the system controller for each unique commissioning code determined by the system device controller.

21. A lighting system comprising:

a communication link;

at least one light fixture connected to the communication link, the light fixture comprising a lamp, a light fixture controller, and a ballast, wherein the light fixture is operable in response to receiving a commissioning command via the communication link to output light from the lamp modulated with a unique commissioning code corresponding to the light fixture; and one or more system devices connected to the communication link, each of the system devices comprising a light sensor, and a system device controller; and wherein:

the light sensor is operable to generate a light sensor output signal that is indicative of modulated light output from the light fixture received at the system device, the system device controller is operable to demodulate the light sensor output signal to determine the unique commissioning code modulated on the light received at the system device, wherein the unique commissioning code is determined from a plurality of unique commissioning codes, and the system device controller comprises a signal transmitter operable to transmit an acknowledgement message via the communication link in response to determining a commissioning code.

22. The lighting system of claim 21, wherein the commissioning command comprises the commissioning code.

23. The lighting system of claim 21 further comprising a system controller coupled to the communication link, wherein said system controller is operable to send the commissioning command to the at least one light fixture and receive the acknowledgement message transmitted by the one or more system devices, wherein the system controller comprises a memory operable to store an address of a light fixture together with an address of a system device receiving light output by the light fixture, and wherein the system controller is one of a dedicated controller, a general purpose computer, or a building management system.

24. The lighting system of claim 23 wherein the system controller is operable to respond to an acknowledgement message from a system device by sending a unique address to the system device via the communication link.

25. The lighting system of claim 21, wherein each of the one or more system devices comprises an occupancy sensor or a light switch, and wherein the acknowledgement message comprises a function of the system device.

26. The lighting system of claim 21, wherein the ballast of the light fixture comprises the light fixture controller of the light fixture, and wherein the commissioning command is a predetermined address of a light fixture.

27. A method of initializing system devices in a lighting system comprising the steps of:

sending an initialize command to a targeted system device in the lighting system by modulating a light output from a light fixture of the lighting system, the light output modulated in accordance with a unique commissioning code from a plurality of unique commissioning codes associated with the lighting system;

receiving the initialize command in the targeted system device by sensing the modulated light output from the light fixture; and in response to receiving the initialize command, sending an acknowledgement message from the targeted system device.

28. The method of claim 27, wherein:

the initialize command is received at the light fixture from a system controller of the lighting system, and the system controller of the lighting system is one of a dedicated controller, a general purpose computer, or a building management system;

the light fixture of the lighting system is a fluorescent light fixture comprising at least one fluorescent lamp and an electronic ballast, wherein said at least one fluorescent lamp is driven by the electronic ballast;

the initialize command comprises an address of the light fixture; and the targeted system device is a light sensor, a light switch, or an occupancy sensor.

29. The method of claim 27, wherein the acknowledgement message sent from the targeted system device in response to receiving the initialize command comprises a function of the targeted system device and a predetermined address of the targeted system device.

30. The method of claim 27, wherein the acknowledgement message sent from the targeted system device in response to receiving the initialize command comprises a function of the targeted system device.

31. The method of claim 30, further comprising in response to sending the acknowledgement message, receiving a unique address at the targeted system device, wherein the unique address is recorded in a memory of a system controller of the lighting system and a memory of the targeted system device receiving the unique address.

32. A method of commissioning a plurality of system devices installed in a lighting system and coupled to a communication link, the lighting system further comprising first and second light fixtures coupled to the communication link, the method comprising:

receiving in the first light fixture a first commissioning command via the communication link;

modulating a light output from the first light fixture in response to the received commissioning command, the modulated light output defining a first commissioning code;

determining the first commissioning code via the modulated light output from the first light fixture at a first set of one or more of the plurality of system devices;

in response to the determined first commissioning code, sending via the communication link an acknowledgement message from the first set of one or more system devices;

receiving in the second light fixture a second commissioning command via the communication link;

modulating a light output from the second light fixture in response to the received commissioning command, the modulated light output defining a second commissioning code;

determining the second commissioning code via the modulated light output from the second light fixture at a second set of one or more of the plurality of system devices;

in response to the determined commissioning code, sending via the communication link an acknowledgement message from the second set of one or more system devices; and based on the acknowledgment messages, associating one or more of the system devices and the first light fixture with a first group, area or zone, and associating one or more of the system devices and the second light fixture with a second group, area or zone.

33. The method of claim 32, wherein the lighting system includes a system controller and the method further comprises:

sending the first and second commissioning commands from the system controller;

the steps of modulating the light output from the first and second light fixtures comprise varying the light output from respective lamps powered by a ballast;

the first and second commissioning codes comprise an address associated with the respective first and second light fixture; and each of the one or more system devices in the lighting system comprises a light sensor, a light switch, or an occupancy sensor.

34. The method of claim 32, wherein a first system device receives modulated light output from each of the first light fixture and the second light fixture, and the step of associating one or more of the system devices and the first light fixture with a first group, area or zone, and associating one or more of the system devices and the second light fixture with a second group, area or zone comprises:

associating the first system device with either one of the first group, area or zone or the second group, area or zone.

* * * * *